US005266086A

United States Patent [19]

Bailey et al.

[11] Patent Number: 5,266,086

[45] Date of Patent: * Nov. 30, 1993

[54] INTERMITTENTLY-FED HIGH-PRESSURE GASIFIER PROCESS

[75] Inventors: John M. Bailey, Dunlap; Abraham L. Zadoks, Peoria, both of Ill.

[73] Assignee: Caterpillar Inc., Peoria, Ill.

[ * ] Notice: The portion of the term of this patent subsequent to Mar. 13, 2007 has been disclaimed.

[21] Appl. No.: 799,665

[22] Filed: Nov. 21, 1991

Related U.S. Application Data

[63] Continuation of Ser. No. 453,746, Dec. 20, 1989, abandoned.

[51] Int. Cl.[5] ..... C10J 3/02

[52] U.S. Cl. ..... 48/203; 48/DIG. 8; 123/3

[58] Field of Search ..... 48/203, DIG. 8, 77, 48/197 R; 123/3, 23

[56] References Cited

U.S. PATENT DOCUMENTS

| | | | |
|---|---|---|---|
| 885,480 | 4/1908 | Jahns | 48/203 |
| 887,989 | 5/1908 | Weber . | |
| 927,418 | 7/1909 | Loomis et al. | 48/203 |
| 1,030,333 | 6/1912 | Rusby et al. | 48/203 |
| 2,269,392 | 1/1942 | Bahney | 48/203 |
| 4,056,080 | 11/1977 | Rutz et al. | 123/23 |
| 4,310,333 | 1/1982 | Schmidt et al. | 48/77 |
| 4,509,957 | 4/1985 | Firey | 48/61 |
| 4,533,362 | 8/1985 | Firey | 48/77 |
| 4,558,664 | 12/1985 | Robben | 123/23 |
| 4,568,361 | 2/1986 | Firey | 48/203 |
| 4,722,303 | 2/1988 | Leonhard | 123/3 |
| 4,782,794 | 11/1988 | Hsu et al. | 123/23 |
| 4,907,565 | 3/1990 | Bailey et al. | 48/77 |

FOREIGN PATENT DOCUMENTS

| | | |
|---|---|---|
| 307134 | 6/1919 | Fed. Rep. of Germany . |
| 960572 | 3/1957 | Fed. Rep. of Germany . |
| 972911 | 10/1959 | Fed. Rep. of Germany . |
| 1496379 | 7/1969 | Fed. Rep. of Germany . |
| 2607745 | 9/1977 | Fed. Rep. of Germany . |
| 2945508 | 5/1981 | Fed. Rep. of Germany . |
| 2945508C2 | 11/1983 | Fed. Rep. of Germany . |

OTHER PUBLICATIONS

DOE/METC-88/6094, "Modeling Diesel Performance With Alternative Fuels", by Kenneth R. Stone, Proceedings of the Annual Coal Fuel Heat Engines and Gas Stream Cleanup Systems Contractors Review Meeting, Sponsored by U.S. Dept. of Energy, Held at Morgantown, W. Va., Held Jun. 14-16, 1988, excerpts: pp. 140-149.

DOE/METC-85/6023, "Coal-Fueled Gas Turbine Systems", by General Electric Company, Gas Turbine Division, Proceedings of the Second Annual Heat Engines Contractors Meeting, sponsored by U.S. Dept. of Energy, held at Morgantown, W. Va., held Apr. 29-May 1, 1985, published Aug. 1985, excerpts: pp. 6-17.

"Cat Gets $4Million Contract", Peoria Journal Star Newspaper, Published: Aug. 24, 1988, Excerpt: p. C8, col. 3.

"Cat Researches Coal Convertor", Peoria Journal Star Newspaper, Published: Aug. 25, 1988, Excerpt: p. C7.

"Researchers Develop Diesel Locomotive That Runs On Coal", Wall Street Journal Newspaper, Published: Aug. 25, 1988, Excerpt: p. C7.

*Primary Examiner*—Peter Kratz

*Attorney, Agent, or Firm*—Anthony N. Woloch

[57] ABSTRACT

An improved gasifier adapted for gasifying a predetermined charge of non-gaseous fuel into fuel gas. Each charge of non-gaseous fuel, which may have optional conditioning materials added to it, is intermittently fed to a gasifier chamber where each charge is partially burned with high-pressure air supplied thereto. High-pressure and temperature fuel gas is produced which is cleansed prior to passing out of the gasifier chamber. After gasification of the charge of fuel is is ended, the gasifier chamber is vented. The residue of the burned charge in the gasifier chamber is removed, along with the contaminated or reacted conditioning materials, and replaced by a fresh charge. The subject invention provides a feasible way of continuously fueling an internal combustion engine with gasified fuel and is compact enough to be practical for even mobile applications.

3 Claims, 3 Drawing Sheets

INTERMITTENTLY-FED HIGH-PRESSURE GASIFIER PROCESS

The U.S. Government has rights in this invention pursuant to Contract No. DE-AC21-88MC-2514 awarded by the U.S. Department of Energy.

This is a continuation of Ser. No. 07/453,746, filed Dec. 20, 1989 now abandoned.

TECHNICAL FIELD

The present invention relates generally to gasifiers and, more particularly to high-pressure gasifiers for the conversion of solid fossil fuels into fuel gas.

BACKGROUND ART

There is a great deal of interest at the present time in the development of an engine that can burn coal in a clean and efficient manner. Coal currently costs only about $1.70 per million British Thermal Units (BTU's) compared with diesel fuel at about $5.00 per million BTU's. Moreover, coal is still an abundant natural resource in the United States of America (U.S.) as well as certain other countries and is therefore expected to help satisfy fuel requirements over the next several hundred years. Thus, coal is an attractive fuel because of its relatively lower cost and because it can provide independence from imported petroleum. Another reason for the interest in the use of coal, especially in locomotive engines, is that U.S. railroad companies own a significant amount of coal reserves.

For the above reasons, the U.S. government has been spending a significant amount of money in recent years on the development of gas turbine and reciprocating engines which can use coal as a fuel. Unfortunately, efforts to date in this direction have not been very successful because of either severe engine wear problems caused by the coal fuel and/or because of the bulk and complexity of conventional coal-fueled engine systems.

Basically, there are three ways in which coal has been used to produce power, namely, 1) feeding coal to external combustion engines which generally operate on the Rankine cycle, 2) injection of coal dust or slurry into a gas turbine engine or diesel-cycle internal combustion engine or, alternatively, ingestion of coal dust into a diesel-cycle engine's intake air, and 3) gasification of the coal and use of the coal gas as a fuel for a modified diesel-cycle engine, gas engine, or gas turbine engine.

The use of coal in an external combustion engine which operates on the Rankine cycle dates back to the beginning of the industrial revolution which occurred in the late eighteenth century. This type of powerplant, in which coal is burned to create steam to operate a reciprocating engine, was extensively used in both mobile and stationary applications. Unfortunately, while a steam powerplant of this type can be used in vehicles, its maximum efficiency is limited to about 15%. Very large Rankine-cycle powerplants having steam turbines are widely used today for the generation of electrical power. While such powerplants have reasonable efficiency for that application, they are not suitable for mobile applications.

The use of a coal slurry as a fuel for diesel-cycle engines is shown, for example, in U.S. Pat. No. 4,558,664 issued to Robben on Dec. 17, 1985 and U.S. Pat. No. 4,782,794 issued to Hsu et al. on Nov. 8, 1988. The use of fumigated coal dust as a fuel for diesel engines is shown, for example, in U.S. Pat. No. 4,056,080 issued to Rutz et al. on Nov. 1, 1977. Neither of these methods have produced much success. While an engine will operate on these fuels with reasonable efficiency, especially at lower speeds, the coal particles and ash cause combustion cylinder wear which is about 50 to 100 times greater than that experienced with diesel fuel. In addition, wear and other problems associated with the fuel system appear to be very difficult to overcome. Consequently, it is not felt that these approaches have a very good long-range potential.

Powerplants which combine a coal gasifier with a reciprocating Otto-cycle engine or gas turbine engine have been known for many years. In the case of a powerplant utilizing a gas turbine engine, coal has been gasified at about 20 atmospheres pressure. After it exits the gasifier, the coal gas is cleaned by various means such as filters for removing particulate matter and zinc ferrite pellet beds for removing sulfur while the temperature of the coal gas is still near the temperature at which it exited the gasifier. The hot cleaned gas, still at about 20 atmospheres pressure, is then injected into the combustor of the gas turbine engine. Operation of the gasifier at the elevated pressure of 20 atmospheres ensures that the coal gas is at a greater pressure than exists in the combustor of the gas turbine engine when injection occurs. This arrangement also reduces the size of the gasifier because of the higher density air supplied thereto and much of the energy contained in the hot coal gas which exits the gasifier can be recovered by expansion through the gas turbine engine. In addition, injection of the coal gas while still at elevated temperature prevents condensation of tars in the coal gas, which can cause serious contamination of various working components of the powerplant.

While manufactured coal gas can be effectively utilized in a gas turbine engine, this type of engine has limitations especially when used in relatively small sizes. Principal among these is lower than desired efficiency especially at reduced power output which occurs in a significant portion of powerplants used for mobile applications. Consequently, for mobile applications it is considered to be more desirable to use the producer gas to fuel a reciprocating engine.

The use of a gasifier to produce a low BTU coal gas to fuel a companion reciprocating engine can provide reasonable efficiency. While the energy content of coal gas produced is only about 100 to 200 BTU's per cubic foot (compared with natural gas whose energy content is about 1000 BTU's per cubic foot), this is not considered a serious problem if the coal gas is utilized immediately following its production in the gasifier. In addition, the coal gas can be cleaned of particulate matter and sulfur which naturally exist in the coal thus assuring adequate life and environmental acceptability for the exhaust products emitted from the engine.

To date, such powerplants have gasified the coal at relatively low pressures of about 1 atmosphere. After exiting the gasifier, the coal gas is cooled to near ambient temperature to condense and remove the tars. The particulates and sulfur in the coal gas are then removed by filtration and chemical reactions. The cooled and cleaned coal gas is then directed to the air intake system of a spark-ignited Otto-cycle or dual-fuel (i.e., ignited by pilot diesel fuel) gas engine.

Engines of this type which induct the fuel gas and intake air as a mixture during an intake phase of the engine cycle are susceptible to detonation or knock which can cause failure of the engine. In order to prevent these problems, these engines are compromised by deliberately limiting their power output and/or by operating them at relatively low compression ratios. The efficiency of the spark-ignited Otto-cycle engine is inferior to that of a diesel-cycle engine not only because of the spark-ignited Otto-cycle engines' relatively lower compression ratios but also because they inherently experience throttling losses while operating at reduced power output.

The loss of available energy which occurs with the cooling of the producer fuel gas prior to cleaning and induction into the engine as well as the present use of engines which are less efficient than diesel-cycle engines result in a less-than-desired overall efficiency for this type of powerplant. In addition, the presently large size of the gasifier (which operates at ambient or low pressures) and associated heat exchangers make this type of powerplant too large and unattractive for use in mobile applications when compared with conventional diesel-cycle engines currently used. Furthermore, conventional gasification of fossil fuels, particularly coal, produces not only fuel gas but also particulates mixed therein which can cause wear and sealing problems in various moving parts of the gasifier.

The present invention is directed to overcoming one or more of the problems as set forth above.

DISCLOSURE OF THE INVENTION

In one aspect of the present invention a method of operating a gasifier having a gasifier chamber is disclosed comprising the steps of:

intermittently feeding the gasifier chamber with compressed air and a predetermined charge of non-gaseous fuel;

gasifying the fuel charge by partially burning it with said compressed air at about said pressure and thereby producing gaseous fuel at about said pressure; and passing the gaseous fuel at about said pressure from the gasifier;

venting the gasifier chamber after said gasifying step is generally completed for that fuel charge; and removing any residual fuel from the gasifier chamber after said venting step is generally completed for that fuel charge.

In another aspect of the present invention a gasifier is disclosed which is adapted for gasifying a predetermined charge of non-gaseous fuel into gaseous fuel. The gasifier includes a gasifier chamber, inlet valve means for admitting pressurized air into the gasifier chamber, outlet valve means for passing the gaseous fuel out of the gasifier chamber, and vent valve means for venting the pressure in the gasifier chamber after the predetermined charge of non-gaseous fuel is gasified.

BEST MODE FOR CARRYING OUT THE INVENTION

Figure 1:
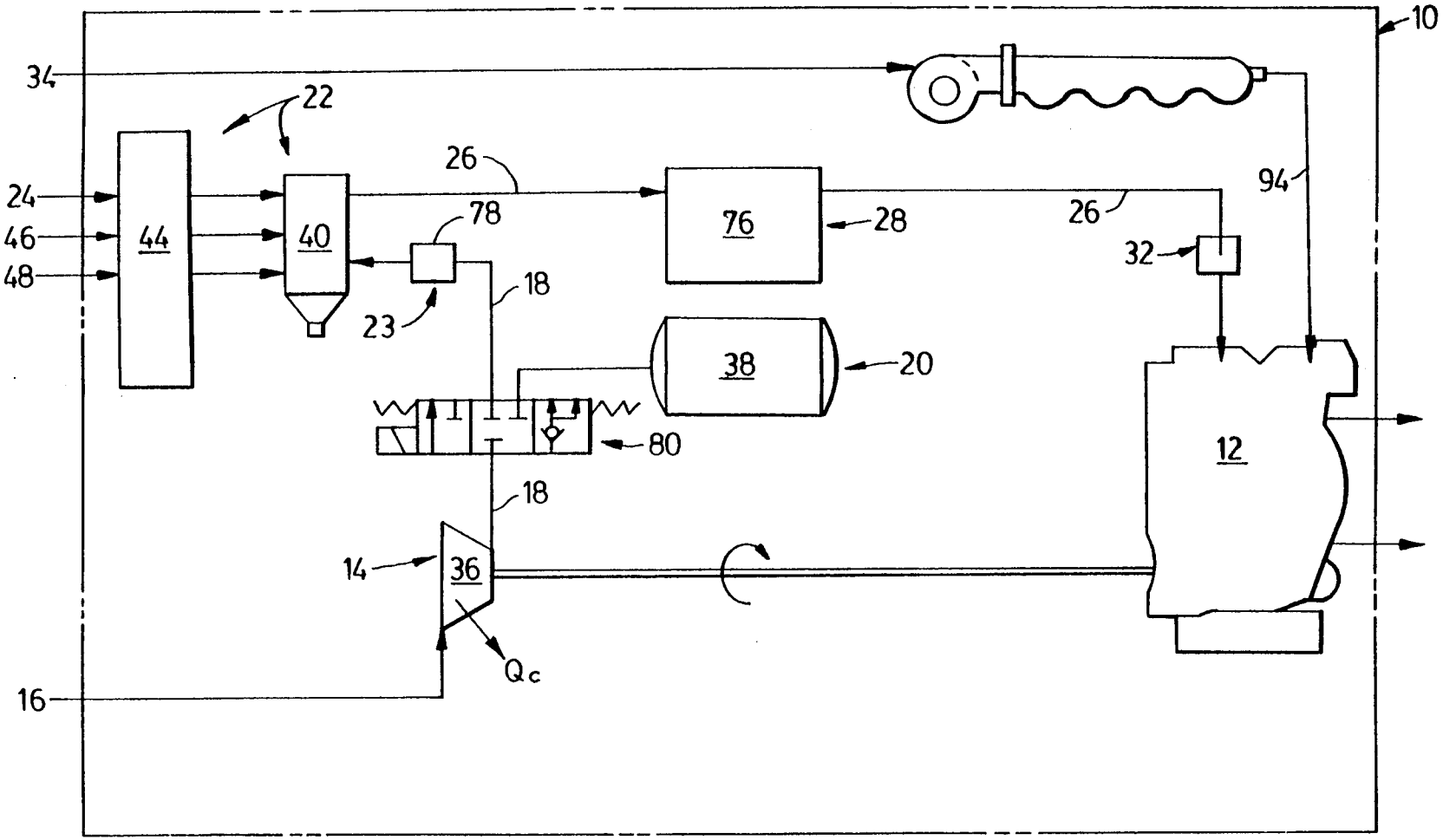
FIG. 1 is a diagrammatic view of one embodiment of the high-pressure gasifier and engine system of the present invention.
Figure 2:
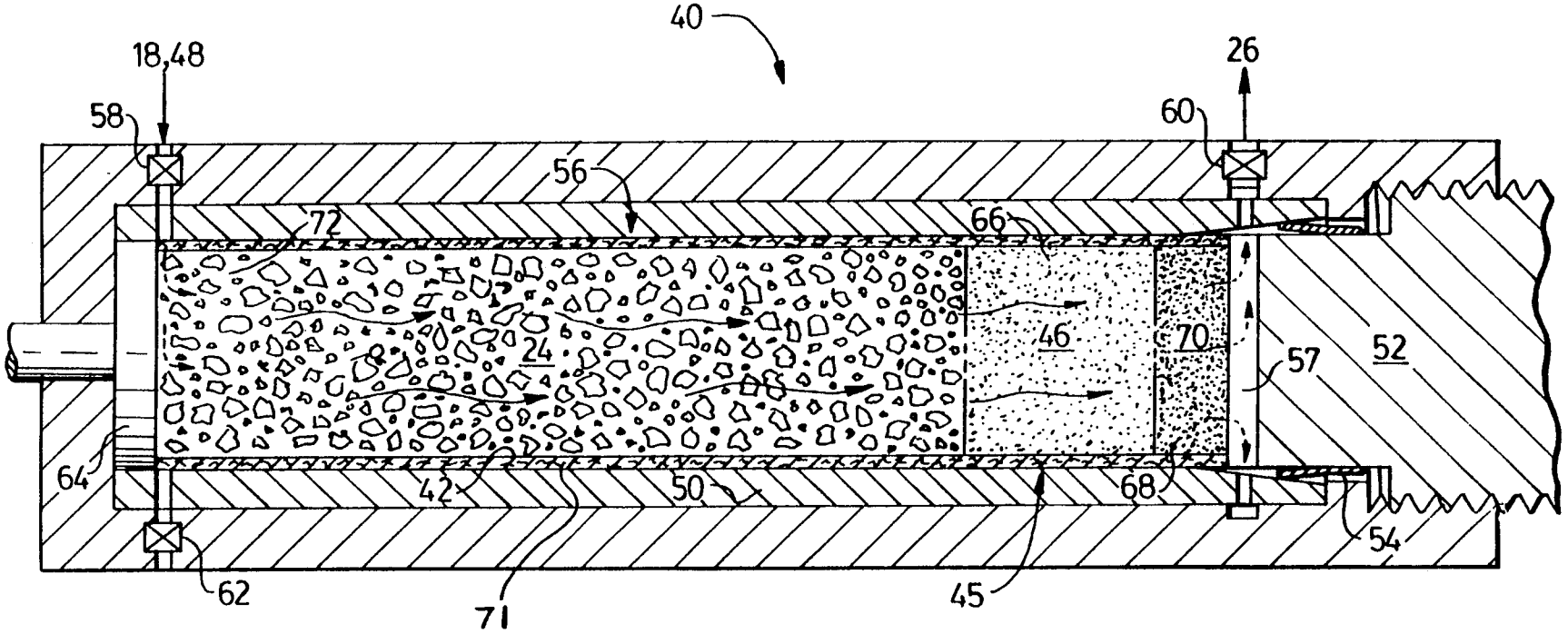
FIG. 2 is a diagrammatic, partial cross-sectional enlarged view of a first embodiment of the high-pressure gasifier of the present invention.
Figure 3:
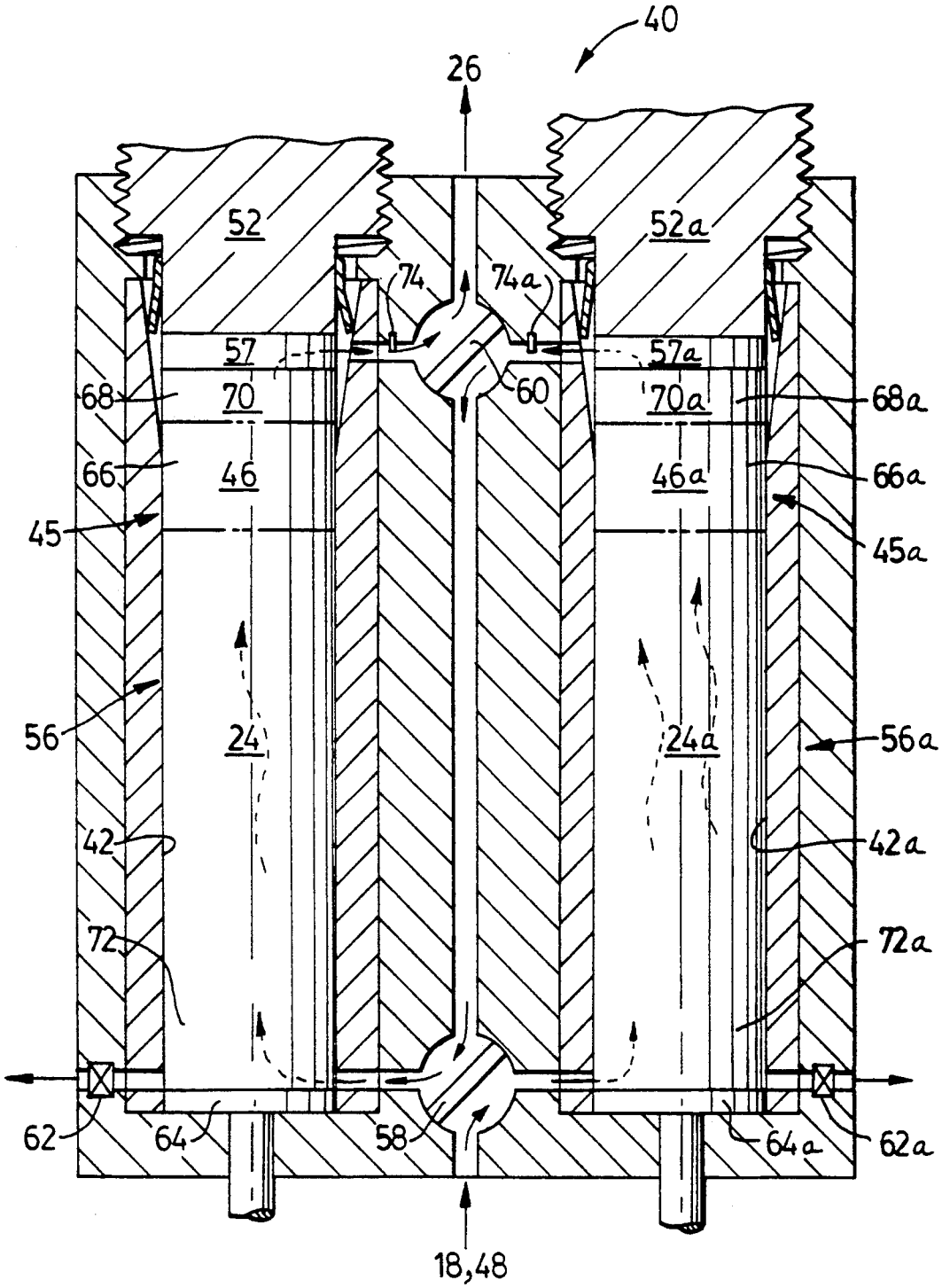
FIG. 3 is a diagrammatic, partial cross-sectional enlarged view of a second embodiment of the high-pressure gasifier of the present invention.

Referring to FIGS. 1-3, wherein similar reference characters designate similar elements or features throughout these figures, there is shown two exemplary embodiments of the improved gasifier and engine system of the present invention. While the embodiments are illustrated and discussed with respect to gasifying coal, it should be kept in mind that other non-gaseous fossil fuels (such as coal tar, peat or heavy residual fuels) may be gasified instead.

In FIG. 1, the overall gasifier and engine system or powerplant 10 for both exemplary embodiments is schematically shown. The system 10 includes a diesel-cycle internal combustion engine 12, a compressor means 14 for compressing ambient or other air 16 into high-pressure air 18, an air storage means 20 for storing and maintaining a predetermined amount of the high-pressure air 18 produced by the compressor means 14, a gasifier means 22 for gasifying a source of non-gaseous fossil fuel 24 with the high-pressure air 18 to thereby produce high-pressure fuel gas 26, an auxiliary ignition-initiating means 23 for initiating the gasification process during startup of the system 10 and a gas cleansing means or device 28 for cleansing the high-pressure fuel gas 26 produced by the gasifier means 22.

The engine 12 includes an engine combustion chamber and associated cylinder (not shown) as well as an injection means 32, such as one or more timed gas admission valves, for injecting the high-pressure fuel gas 26 into the engine combustion chamber. During an intake phase of the diesel cycle, the engine combustion chamber is adapted to admit therein a predetermined quantity of intake air 34 which, for example, may be ambient air or supercharged air. During a compression phase of the cycle and prior to a combustion phase, the engine combustion chamber is adapted to compress the intake air 34 to a predetermined maximum pressure $P_1$. The injection means 32 is adapted to inject the high-pressure fuel gas 26 into the engine combustion chamber during a latter portion of the compression phase of the diesel cycle and just prior to the combustion phase. Preferably, the high-pressure fuel gas is injected at a preselected time during the second half of the compression phase wherein the second half of the compression phase is defined as that part of the compression phase in which the volume of the combustion chamber is less than half of its value at the beginning of the compression phase.

Preferably, the fuel gas is injected directly into an open combustion chamber of the engine 12 in the form of discreet high-velocity gas jets near top dead center of the compression phase. Alternatively, the fuel gas may be injected into a precombustion chamber of the engine. Regardless of the engine combustion chamber chosen, the engine 12 further includes a means 33 (not shown) for assisting ignition of the fuel gas 26. The ignition-assist means 33 may, for example be a spark plug or a glow plug projecting into the engine combustion chamber. One example of a suitable combustion chamber, injection means 32 and ignition-assist means is shown in U.S. Pat. No. 4,721,081 issued to Krauja et al. on Jan. 26, 1988.

The compressor means 14 includes an air compressor 36 which is preferably of the multi-stage type and driven by the engine 12. The compressor 36 is adapted to compress the other air 16 to a predetermined second pressure $P_2$ which is greater than the first pressure $P_1$ periodically developed by the engine combustion chamber during the compression phase of the intake air 34. The second pressure $P_2$ is preferably chosen to be of a magnitude sufficient so that the injected fuel gas can overcome not only the first pressure $P_1$ in the engine combustion chamber but also the instantaneous pressure developed therein by the burning fuel gas and air during the combustion phase. The relatively greater magnitude of the second pressure $P_2$ helps ensure that the injected fuel gas adequately penetrates and mixes throughout the intake air in the engine combustion chamber. For example, the magnitude of the second pressure $P_2$ may be chosen to be about 1.25 times the magnitude of the first pressure $P_1$. The compressor 36 is arranged to be in fluid communication with the gasifier means 22 and is adapted to feed its high-pressure air 18 to the gasifier means 22 to facilitate gasification and production of the high-pressure fuel gas 26.

The air storage means 20 includes, for example, an air storage tank 38 arranged in fluid communication between the compressor means 14 and the gasifier means 22. The purpose of the air storage tank 38 is to reduce pressure fluctuations in the system 10 and to store and maintain a predetermined amount of the high-pressure air 18 for use in starting the system 10.

Gasification of coal at the very high pressures required for a diesel-cycle engine is far beyond the current state of the art of gasifiers because of mechanical and thermal problems presently encountered with the lock hopper valves used in conventional low pressure gasifiers. These problems are primarily caused by improper sealing of such valves which become contaminated by the coal and ash particles. However, the subject invention employs novel batch loading and in-bed conditioning features which help maintain a relatively clean environment in the gasifier and therefore ameliorate sealing of the critical inlet air, vent and exit gas valves. Batch loading of the gasifier is made possible by the use of these valves and periodic venting of the individual gasifier chambers. Batch loading is also made possible in the subject invention by the relatively much smaller size of the individual gasifier chambers due to the very high pressures at which the gasifier operates.

The gasifier means 22 includes a gasifier 40 having at least one gasifier chamber 42 (as shown in FIGS. 2 and 3), which is arranged in intermittent fluid communication with the compressor means 14 and also the engine combustion chamber. The gasifier means 22 also includes a material handling means 44 for intermittently feeding a predetermined charge of non-gaseous fossil fuel 24, high-pressure air 18 and perhaps other necessary materials 46, 48 (such as limestone and water) to the gasifier chamber 42 and intermittently removing any residual material (such as ash) from the gasifier chamber 42 after gasification of that charge is completed. The gasifier means 22 also includes a conditioning means 45 for conditioning the produced coal gas to remove particulates and/or sulfur before the coal gas exits the gasifier chamber 42.

The gasifier chamber 42 might be of any of the conventional types, reduced appropriately in size. However, a fixed bed gasifier chamber is preferred because it can use relatively large size coal. More importantly, fixed-bed gasifiers are amenable to the use of batch loading and in-bed conditioning features.

Regardless of the type of gasifier chamber 42 chosen, the conditioning means 45 may include apparatus which feeds water to the gasifier chamber in order to control the chemical composition of the fuel gas as well as the gasifier temperatures. The conditioning means 45 may also include apparatus for feeding limestone, lime, or other calcium-containing material 46 along with the coal 24 in order to neutralize any sulfur contained in the coal. The calcium reacts with the sulfur to form calcium sulfide (CaS) which may be further oxidized (in the gasifier 40 or following removal from the gasifier) to the more stable calcium sulfate ($CaSO_4$). There are some indications in the published literature that the calcium/sulfur reaction is enhanced by operating the gasifier 40 at the relatively high pressure of about $P_2$. Because the gasifier is greatly reduced in size, it may also be preferable to feed the discreet charges of coal and limestone, if required, into the gasifier 40 in the form of prepared cartridges or capsules.

FIG. 2 illustrates a first embodiment of the gasifier 40 having the aforementioned gasifier chamber 42. The gasifier chamber 40 includes a liner 50 composed of a heat resistant insulating material such as partially stabilized zirconia. A closure means, such as closure 52 and seal 54, are used to seal the entrance of the gasifier chamber 42 following insertion of a fresh charge of coal 24 and possibly other materials 46 all of which are preferably arranged in the form of an expendable cartridge 56. The gasifier chamber 42 or closure 52 includes a porous end portion 57 which, when the gasification chamber entrance is sealed by the closure, has a configuration that permits egress of the fuel gas 26 from the gasification chamber 42 but not egress of the non-gaseous material therein including the ash and inert material comprising filter 70. An inlet valve means, such as inlet valve 58, controls the inlet of high-pressure air 18 (supplied by the compressor means 14) into the chamber 42. An outlet valve means, such as outlet valve 60, controls the exit of generated high-pressure coal gas 26 from the gasifier chamber 42. Vent valve 62 is used to vent the gasifier chamber 42 to permit ejection of ash by an axially-movable ejector means, such as ejector 64, and insertion of a fresh coal cartridge 56.

Each fresh coal cartridge 56 primarily includes granulated coal 24 but may also include the conditioning means 45 as an integral part thereof. In this example, the conditioning means 45 includes granulated limestone 46 located as a generally stratified layer adjacent to the gas exit end portion of the cartridge as shown generally at 66. Alternatively, the granulated limestone 46 and coal 24 may be arranged as a generally homogeneous mixture within the coal cartridge 56. Moreover, the conditioning means 45 further includes a relatively small and expendable filter 70 located at the gas exit end portion 68 of the cartridge 56. The filter 70 is composed of granulated inert material, such as sand, which filters particulate material from the fuel gas 26 exiting the gasifier chamber 40. The granulated material of a fresh cartridge 56 may, for example, be already compressed, cemented or otherwise strengthened to maintain its shape. Moreover, the granulated material is preferably wrapped with an expendable casing (71), such as reinforced paper or cardboard, to prevent abrasion while handling the cartridge 56. The coal cartridges 56 are stored and automatically fed to the gasifier chamber 42 by suitable conveyors (not shown).

Following insertion of a fresh coal cartridge 56, closure 52 is closed and secured, vent valve 62 is closed and inlet valve 58 is opened to admit high-pressure air 18 from the compressor means 14. When the pressure in the gasifier chamber 42 reaches, for example, about 20 mega-Pascals (MPa), equivalent to 200 bar or 200 atmospheres, the outlet valve 60 is opened and high-pressure air 18 begins to flow through the porous material of the cartridge 56 and pass out through the outlet valve 60 and then to the injection means 32 of the engine 12. For startup, the coal located at the air entrance end portion 72 of the cartridge 56 is ignited by injecting high-pressure natural gas from a suitable storage tank (not shown) into the high-pressure air 18 as it passes through a small auxiliary combustion chamber 78 containing an energized glow plug or other ignition-assist device (not shown).

Following ignition of the granulated coal, an ignition and burning zone passes through the coal cartridge 56 from left to right (according to FIG. 2) similar to what occurs in a burning cigar. Consequently, the high-pressure air 18 passing through the ash initially formed at the left-hand portion of the cartridge 56 is pre-heated, the granulated coal is gasified in the gasifier chamber 42 and the hot high-pressure coal gas 26 pre-heats the granulated coal and vaporizes the coal liquids. As the reaction zone progresses, the ejector 64 progressively moves to the right (according to FIG. 2) keeping the remaining charge and ash generally compact. Water 48 is injected into the entering high-pressure air 18 as required for the gasifier reaction.

Following conversion of all the coal, the ejector 64 will have moved axially all the way to the right. Moreover, the ash, reacted limestone and filter material, remain in the gasifier chamber 42 which at this time is still filled with high-pressure air 18. Inlet valve 58 and outlet valve 60 are then closed. Vent valve 62 is then opened to reduce the pressure inside the gasifier chamber 42 to ambient pressure, the residual material is ejected and a fresh cartridge 56 inserted into the gasifier chamber 42.

Alternatively, the discreet charges of granulated coal 24 and possibly other materials may be metered into a reusable casing which is then inserted into the gasifier chamber 42. After a charge has been gasified, the reusable casing containing the residual fuel and/or ash is removed from the gasifier chamber 42, emptied and refilled with a fresh charge. Alternatively, the charge of granulated coal 24 and possibly other materials may be metered directly into the gasifier chamber 42.

FIG. 3 shows a second alternative embodiment of the gasifier means 22 having a gasifier 40 which includes at least two gasifier chambers 42 and **42*a* to permit alternate ejection and loading of those chambers. In addition, the coal gas exiting the first cartridge 56 undergoing gasification is directed to pass through the second fresh coal cartridge 56*a*. As the first cartridge 56 nears the end of its burning phase, the exiting hot coal gas 26 ensures ignition of the second cartridge 56*a* as soon as sufficient oxygen is introduced in the second gasifier chamber 42*a*. When the first cartridge 56 is finally burned out, the drop in temperature of the exiting coal gas 26 is sensed by a thermocouple 74 and the inlet valve 58 is rotated through 90 degrees thus effectively isolating the first gasifier chamber 42. Vent valve 62 is opened to relieve the pressure in the first gasifier chamber 42 and ejection and reload then automatically occurs as previously described. Thermocouple 74*a*, outlet valve 60, and vent valve 62*a* operate in concert with the previously mentioned components to effect ejection and reload of the second gasifier chamber 42*a***.

The rate of progression of the reaction zone through each coal cartridge 56, **56*a* is controlled by the availability of oxygen. Assuming that the compressor means 14 supplies the air at a reasonably stable pressure, the flow of oxygen (air) entering the coal cartridge 56, 56*a* is dependent on the flow of produced coal gas to the engine 12 which is in turn controlled by an engine governor (not shown). Thus the gasifier and engine system 10 tends to be self-regulating. In order to conserve fuel, it may be desirable to reduce the pressure of the compressor means 14 (and consequently the pressure of the gasifier means 22**) at low engine loads.

As mentioned earlier, water 48 can be injected as required to form steam which may be needed for the gasification process. Control of water injection, ejection, and reload and other necessary functions are preferably controlled by a suitable electronic control device (not shown). Preferably, this electronic control device also controls the timing and duration of fuel gas injection into the engine 12 as well as other engine functions.

Preliminary calculations indicate that a coal cartridge 8 inches in diameter and 36 inches long can fuel a 3 megawatt engine for about one minute at rated engine output. This duration is long enough to facilitate practical ejection and reload sequences of coal cartridges 56 into the gasifier chamber 42. The coal cartridge 56 would, of course, operate the engine 12 for much longer periods at reduced engine load.

The gas cleansing means 28 includes a gas cleansing device 76 whose function is to condition the high-pressure fuel gas 26 by removing most particulates and chemically neutralizing any noxious gases. The gas cleansing device may include, for example, a zinc ferrite pellet bed through which the hot coal gas 26 is passed. The zinc ferrite pellet bed is used for sulfur removal, in lieu of limestone placed in the fixed bed gasifier chamber 42, or to remove any residual sulfur in the coal gas 26 even if limestone is used. If limestone is used in the fixed bed gasifier chamber 42, the coal gas might be alternately passed through two pellet beds. While one pellet bed is used to capture the sulfur, the other is regenerated by passing steam through that pellet bed. The steam removes the absorbed sulfur by creating sulfur dioxide ($SO_2$) and this is passed in concentrated form back through the limestone in the fixed bed gasifier chamber 42 for effective reaction with the calcium. This latter arrangement is well known in the art.

If a conventional gasifier is used or if the porous filter 70 in the coal cartridge 56 is not completely effective in removing all particulates which are deleterious to the engine 12, one or two cyclone stages may be used to remove particulates produced by the gasifier. It is also well known in the art that porous ceramic filters of the wall flow type can effectively remove particulates. Regardless of the type of wall flow filter, the very high density of the coal gas permits the filter to be relatively small without incurring excessive pressure drop.

Industrial Applicability

A major advantage of carrying out gasification at about 20 MPa evolves from the fact that the air is about 200 times as dense as it is at atmospheric pressure, assuming the same temperature. Consequently, the volume of the gasifier 40 may be reduced by approximately the same ratio. This is very important where the gasifier and engine system 10 is to be used as a power plant for a locomotive or other mobile application. In addition, only the air required for the gasifier 40 is compressed.

The coal, water and limestone, if used, are added to the gasifier 40 in solid or liquid form which requires much less energy than would be required if these materials were first converted to gas. The additional moles of gas generated in the gasifier 40 causes an increased gas flow which is effectively used for penetration and mixing of the intake air 34 and production of power when injected into the modified diesel-cycle engine 12.

The gasifier and engine system 10 is started by opening the valve from the air storage tank 38. The air storage tank was previously closed when the engine 12 was shut down in order to maintain its air pressure at about 20 MPa. This high-pressure air 18 flows from the air storage tank 38 to a relatively small auxiliary combustion chamber 78 wherein natural gas or methane from a high-pressure bottle is injected. The gas/air mixture is ignited by a glow plug (which would have been preheated prior to the start sequence) or a sparkplug. Combustion products from the auxiliary combustion chamber 78 then enter the gasifier chamber 42, 42*a* and pass through the fresh coal cartridge 56. Upon exiting the gasifier chamber 42, the combustion products pass through the gas cleansing means 28 and are then injected directly into the engine combustion chamber by the injection means 32. This action cranks the diesel engine 12 similar to the manner in which some conventional engines are started with compressed air.

As the flow of hot combustion products of the natural gas/air combustion continue to pass through the gasifier chamber 42, the coal cartridge 56 ignites and gasification of the coal occurs as previously described. The conditioning means 45 in the form of sand filter 70 as well as the granulated limestone 46 help ensure that the exiting coal gas is relatively clean so as not to undermine the sealability of the gasifier chamber 40 when it operates at high pressure. The conditioning means 45 described above also facilitates easy disposal of the residual products of gasification remaining in the gasifier chamber. The coal gas thus generated is burned in the engine combustion chamber resulting in an increase in engine speed.

Following sustained operation of the engine 12 on coal gas, the natural gas valve is closed and the startup ignition system is de-activated. Operation of the engine 12 at normal speeds then drives the direct-connected compressor 36, air is compressed to return the pressure in the air storage tank 38 to about on 20 MPa, and the self-sustained operation of the system is established.

It is apparent that the high-pressure natural gas bottle would have to be periodically replaced or recharged. An alternative to the use of natural gas would be the incorporation of a readily ignitable material, such as a solid propellant in the initial coal cartridge used for starting and provision of a suitable ignition device. When ignited, the readily ignitable material should be capable of producing a temperature which is sufficiently high to ignite the coal.

When the engine 12 is shut down, a valve 80 at the air storage tank 38 is closed to maintain the tank pressure at a level sufficient for the next starting sequence.

It should be kept in mind that a direct gas injection engine requires fuel gas to be at a pressure that is significantly greater than the compression pressure of the diesel engine to assure rapid penetration and mixing of the gas jets with the compressed intake air in the combustion chamber. Since the fuel gas 26 produced by the gasifier 40 is already at a relatively higher pressure $P_2$, injection of the high-pressure fuel gas near top dead center in a direct gas injection diesel-cycle with glow plug or spark plug ignition results in performance quite similar to a conventional diesel-cycle liquid fuel injection engine.

Because the gas burns almost immediately upon injection, there is no undesirable accumulation of fuel gas in the combustion chamber as in the case of Otto-cycle gas engines where the fuel gas is inducted with the intake air during an intake phase of the Otto cycle. With the conventional gas engine, part of the gas/air mixture, often referred to as "end gas", may detonate near the end of the combustion phase. This detonation can cause failure of the engine in a very short time. In order to avoid such failure, the conventional approach has been to require that the engine operate at a lower than desired compression ratio, which results in reduced efficiency, and/or that the engine operate at a reduced specific power output compared with a diesel engine. These problems are eliminated by direct gas injection utilized in the present invention. This is especially desirable when using coal gas because this gas typically contains hydrogen gas which is very prone to detonation.

Other aspects, objects, and advantages of this invention can be obtained from a study of the drawings, the disclosure, and the appended claims.

We claim:

1. A method of operating a gasifier having a gasifier chamber and a closure means for selectively opening and sealing the gasifier chamber, comprising:

opening the closure means and feeding the gasifier chamber with a charge of non-gaseous fuel while the gasifier chamber is at atmospheric pressure wherein the charge of non-gaseous fuel is arranged in the form of an expendable cartridge;

sealing the closure means;

feeding the gasifier chamber with a continuous supply of compressed air at a chosen pressure greater than atmospheric pressure while the closure means is sealed;

gasifying the fuel charge by partially burning it with said compressed air at said chosen pressure and thereby producing gaseous fuel at said chosen pressure; and passing the gaseous fuel at said chosen pressure from the gasifier chamber sealed by the closure means;

venting the gasifier chamber after said gasifying step is completed for that fuel charge; and opening the closure means and removing residual fuel from the gasifier chamber.

2. A method of operating a gasifier having a gasifier chamber and a closure means for selectively opening and sealing the gasifier chamber, comprising:

opening the closure means and feeding the gasifier chamber with a charge of non-gaseous fuel while the gasifier chamber is at atmospheric pressure wherein the step of feeding the gasifier chamber includes the step of metering the charge of non-gaseous fuel into a reusable casing and then inserting the casing into the gasifier chamber;

sealing the closure means;

feeding the gasifier chamber with a continuous supply of compressed air at a chosen pressure greater than atmospheric pressure while the closure means is sealed;

gasifying the fuel charge by partially burning it with said compressed air at said chosen pressure and thereby producing gaseous fuel at said chosen pressure; and passing the gaseous fuel at said chosen pressure from the gasifier chamber sealed by the closure means;

venting the gasifier chamber after said gasifying step is completed for that fuel charge; and opening the closure means and removing residual fuel from the gasifier chamber.

3. The method of claim 2 wherein the step of removing the residual fuel from the gasifier chamber includes the step of removing the reusable casing from the gasifier chamber.

* * * * *